United States Patent [19]

Hanuszczak

[11] 4,078,706

[45] Mar. 14, 1978

[54] MOLTEN METAL METERING AND TRANSFER DEVICE WITH DISPLACEMENT PISTON

[75] Inventor: Sergio Hanuszczak, Chicago, Ill.

[73] Assignee: Casting Technology Corporation, Chicago, Ill.

[21] Appl. No.: 731,203

[22] Filed: Oct. 12, 1976

[51] Int. Cl.[2] ..... B22D 39/00

[52] U.S. Cl. ..... 222/596; 164/312; 222/385

[58] Field of Search ..... 222/594, 596, 309, 405, 222/345, 346, 355, 356, 361, 385, 319; 164/310, 312, 337

[56] References Cited

U.S. PATENT DOCUMENTS

| | | | |
|---|---|---|---|
| 760,991 | 5/1904 | Hough | 222/385 X |
| 907,274 | 12/1908 | Neureuther | 222/356 |
| 2,382,369 | 8/1945 | Smith | 222/356 X |
| 3,261,060 | 7/1966 | McAlpine et al. | 222/361 |

*Primary Examiner*—Robert B. Reeves
*Assistant Examiner*—David A. Scherbel
*Attorney, Agent, or Firm*—Silverman & Cass, Ltd.

[57] ABSTRACT

A molten metal metering and transfer device for use with a molding machine and a bath for holding and heating molten metal includes an elongate container which is supported in the bath with one end extending out of the bath and the other extending into the bath. An entry port is formed in the side of the container to allow molten metal to flow into the container and an exit port is formed in the container adjacent the top and above the bath. A uniquely formed plunger seated in the container moves downward into the bath, then upward out of the bath, trapping a predetermined amount of molten metal above its top surface. The formation of the plunger facilitates flow of the molten metal out of the container when the plunger reaches the exit port.

16 Claims, 2 Drawing Figures

MOLTEN METAL METERING AND TRANSFER DEVICE WITH DISPLACEMENT PISTON

BACKGROUND OF THE INVENTION

This invention relates to molten metal metering and transfer devices and more particularly to such devices for use with cold chamber casting machines.

Two different types of molten metal metering and transfer devices are commonly used today to supply the molten metal used in castings. One type of device is commonly known as a hot chamber and is generally employed with low temperature metals such as zinc, or lead. A second type of device is commonly termed a cold chamber and is more commonly utilized with high temperature materials such as aluminum, magnesium and bronze.

Hot chambers generally take the form of a gooseneck structure which is partially or completely emersed in a molten metal bath. The molten metal enters the gooseneck structure through an entry port, and a piston seated in the gooseneck structure is actuated by a hydraulic system forcing the molten metal up through the gooseneck and out an exit sprue into the mold to be filled. This type of device requires a piston and hydraulic assembly which are strong and can overcome the pressures exerted by the molten metal, in order to push the molten metal into the casting. The distance moved by the hydraulically controlled piston is determined not by the amount of material to be displaced but by the amount of material necessary to fill the casting and by the pressure developed when the casting has been filled.

With cold chamber devices, a chamber is located outside of a molten metal bath and is connected at one end to a die casting machine. A piston and hydraulic operator are connected to the cylinder at the other end. Between the two ends, somewhat closer to the piston, is an input or fill port. Molten metal from a bath is usually brought to this fill port by way of a trough extending from a molten metal bath to the cylinder. The cylinder is commonly termed a shot sleeve.

In a hand operation, the operator dips a ladle into the molten metal, then raises the ladle to the top of the bath resting the ladle bowl on the top of the bath adjacent the trough. The ladle is then tipped allowing the molten metal in the ladle to flow into the trough and to the shot sleeve. The operator attempts to visually coordinate the amount of metal necessary in the shot sleeve and the amount of metal dispersed from the ladle. In such a hand operation, dispersing a uniform amount is difficult. Furthermore, because of the manner in which the ladle is pivoted over onto its side to allow exit of the molten metal, it is difficult to control the amount of metal which is dispersed and the speed at which it flows. Consequently, the dispersing of a uniform amount on each use is difficult and potentially dangerous should an excessive amount be released which overflows the trough.

Most attempts at automating the metering and transfer procedure used in a cold chamber utilize equipment and devices which attempted to copy identically the motions of the machine operator in a hand operation. In these systems, a ladle is dipped into the molten metal bath then slowly raised and pivoted over into the trough until the molten metal flows into the trough. Some systems, instead of pouring out of a lip on the ladle, pour through a hollow in the handle so that the ladle only had to be dipped, then pivoted back and up in order to disperse the molten metal. In any case, these systems have the same deficiencies as with the hand ladling. Specifically, the amount of material picked up into a ladle and then dispersed cannot be controlled with any degree of accuracy. Because the dispersal of the molten material is a function of gravity, there is great danger that once the coefficient of friction for the material has been exceeded due to pivoting of the ladle, a large mass of the molten metal will begin to flow very rapidly and could not be controlled so that a danger of spillage and injury is present.

A second type of molten metal metering and transfer device is utilized wherein the molten metal in the bath is maintained in a hermatically sealed container. Pressure is applied to the bath in the container so that the molten metal is forced upward in the container. The molten metal forced upward is expelled through a small aperture near the top of the housing which connects with the trough coupled to the shot sleeve.

In this type of apparatus, a great many parts are required and the operation is quite complex and dangerous. Application of excessive pressure without checks can cause an explosion which would send molten metal flying through the air. It is very difficult to control the precise amount of material expelled upon application of a specific amount of pressure because of the lack of homogeninity in molten metal which is partially caused by the passage of air under pressure through the molten metal. In any case, as noted, these versions are extremely complex and expensive in order to provide all of the controls necessary for proper and safe operation.

SUMMARY OF THE INVENTION

In practicing this invention, a molten metal metering and transfer device is provided for use with a molding machine and a bath for holding and heating molten metal. The device includes a hollow elongate container. Shoulders on the container allow it to be supported in a bath with the top end extending out of the bath and the bottom end extending into the bath. An aperture formed through the wall of the container is partially submerged in the bath and allows the molten metal to enter the chamber in the container. An exit port is formed in the container adjacent its top end. A plunger is seated in the chamber in the container and is adapted to move down into the bath, then back out of the bath trapping a predetermined amount of molten metal above the top surface of the plunger. The top surface of the plunger extends at a first obtuse angle with respect to the axis which facilitates free flow of the molten metal from the plunger to the exit as the plunger top surface approaches the exit height.

DETAILED DESCRIPTION OF THE PREFERRED EMBODIMENT

Figure 1:
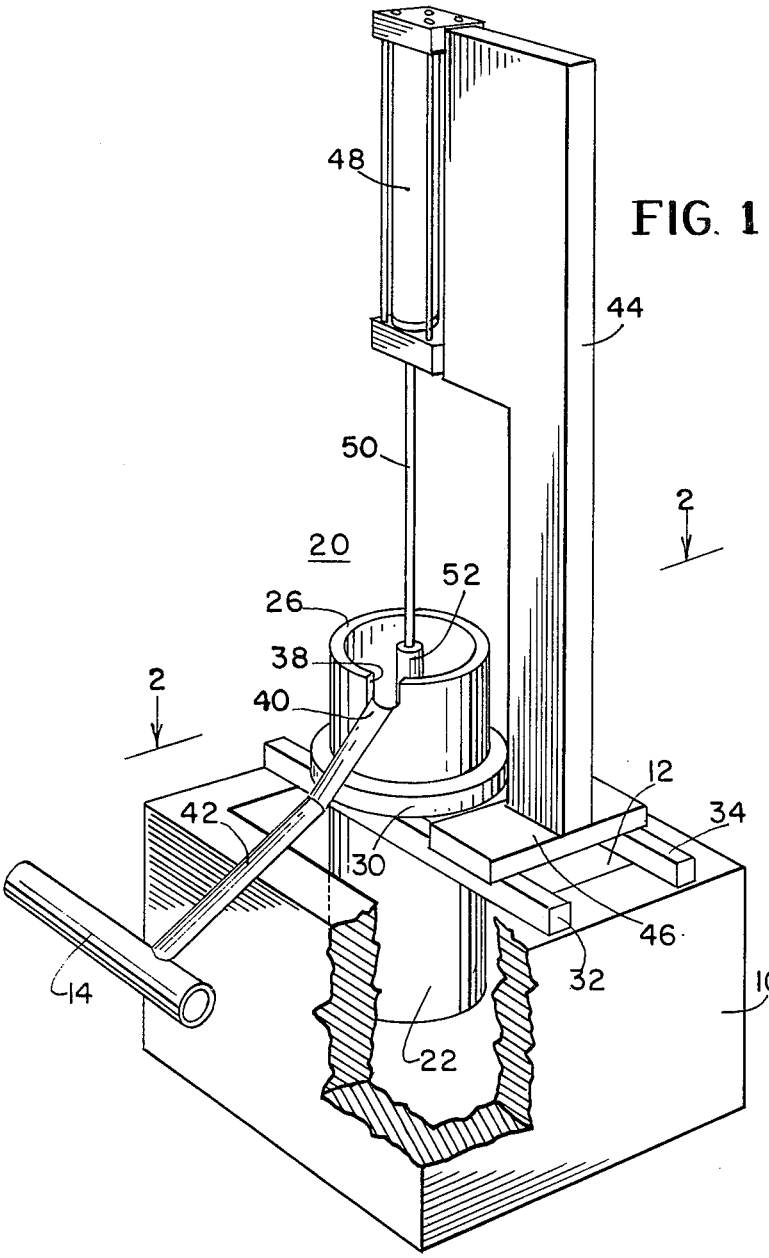
FIG. 1 is a perspective view of the metering and the transfer device of this invention seated in a molten metal bath.

Referring to FIG. 1, there is shown a molten metal bath 10 for heating metal to a molten state and holding the molten metal for use in a casting process. In the embodiment shown, bath 10 is filled with molten aluminum 12.

Aluminum has a very high melting point and it is also very corrosive. Because of its high temperature and corrosive characteristics, aluminum is generally cast using a cold chamber device connected to a mold in which the casting is to be formed. A part of the cold chamber device, specifically, the shot sleeve 14 for the cold chamber device is shown in the Figures.

A molten metal metering and transfer device 20 is shown seated in molten metal bath 10. Device 20 includes an elongate cylinder 22 which forms a cylindrical chamber 24. In the preferred embodiment, cylinder 22 is formed from carbon bonded silicon carbide in order to withstand the high temperature and corrosive characteristics of molten aluminum. Cylinder 22 has an open top 26 and an open bottom 28 with the bottom extending into the molten aluminum 12 in molten metal bath 10, and the open top 26 extending out of bath 10. Cylinder 22 is seated in bath 10 such that the axis of cylinder 22 extends substantially perpendicular to the surface of bath 10. A shoulder 30 is formed on the outer surface of cylinder 22 for supporting the cylinder in bath 10. Shoulder 30 rests on support rails 32 and 34 which extend across the bath 10 and rest on the upper edges of the side walls forming bath 10.

Figure 2:
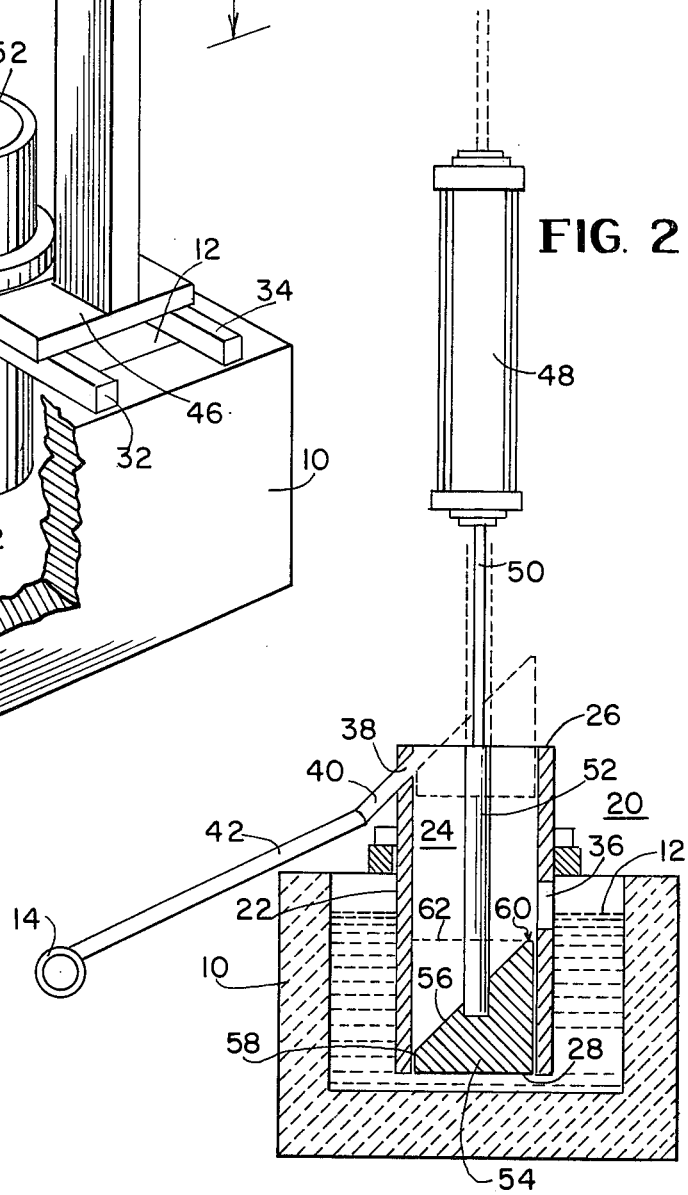
FIG. 2 is a section view of the structure of FIG. 1 taken along the lines 2–2' in FIG. 1.

An entry port or entry aperture 36 is formed through the side wall of cylinder 22 and is shown in FIG. 2. This entry port is partially below and partially above the surface of the molten metal 12 when cylinder 22 is seated in bath 10 so that the molten metal from the bath can enter chamber 24. An exit port 38 is formed in the side wall of chamber 22 adjacent top end 26 for allowing exit of molten metal from chamber 24 in a manner to be explained in greater detail subsequently. Exit port 38 has a bottom surface or wall 40 which is pitched at an obtuse angle with respect to the axis of cylinder 22. A conduit pipe or conduit trough 42 connects exit port 38 with shot sleeve 14.

Molten metal metering device 20 also includes a support arm 44 mounted to a base 46. Base 46 seats on support rails 32 and 34 and the support arm 44 extends in the axial direction of cylinder 22 above cylinder 22. A hydraulic piston 48 is secured to the distal end of support arm 44 and is positioned directly in line with the axis of cylinder 22. Hydraulic piston 48 includes a plunger rod 50 which extends from the end of piston 48 vertically directly along the axis of cylinder 22. The distal end of plunger rod 50 is connected by way of a right and left hand union stud to a plunger stem 52 which extends into cylinder 22 along the axis thereof. Plunger stem 52 is formed from steel protected with plastic refractories in order to protect it from the corrosive characteristics of the molten aluminum. Plunger stem 52, at the end opposite to the end connected to plunger rod 50 is connected to a plunger 54 which is seated in cylinder 22.

Plunger 54 takes the form of a truncated cylinder, which has a top surface 56 that extends at an obtuse angle with respect to the axis of cylinder 22 and the top surface of bath 10 and molten aluminum 12. When plunger 54 is raised to the topmost position in chamber 24, the lowest point 58 of top surface 56 is positioned adjacent to the portion 40 of exit port 38 and the highest point 60 of top surface 56 is positioned substantially opposite to portion 40 of exit port 38 and above this point. Plunger 54 in the preferred embodiment is formed from carbon bonded silicon carbon, the same material used to form cylinder 22.

In operation, the casting machine operator actuates a switch (not shown) which controls the hydraulic piston 48 causing it to move plunger rod 50 out of piston 48 in a downwardly direction. This forces plunger 54 downward into cylinder 22. Plunger 54 continues its downward movement until the full extension of plunger rod 50 is reached. At this maximum depth, the uppermost point 60 of top surface 56 on plunger 54 is below aperture 36 formed on the side wall of cylinder 22.

The casting operator now reverses the switch controlling hydraulic piston 48 causing the piston to raise plunger rod 50 and plunger 54. As plunger 54 rises in cylinder 22 from its lowest point therein, it will force excess molten metal in chamber 22 out into bath 10 through entrance aperture 36. Metal will be forced out until the highest point 60 of top surface 56 rises above entrance aperture 36, at which point the entrance aperture 36 will be sealed by the side of plunger 54.

At this point a predetermined amount of molten metal will be trapped above top surface 56 of plunger 54. The amount trapped will be substantially triangular in cross section and will have a top surface 62 or level at substantially the top point 60 of top surface 56. The top surface level of the trapped molten metal is shown in FIG. 2 by the dash lines 62.

Plunger 54 continues to rise upward in chamber 24 of cylinder 22 towards exit port 38. Although plunger 54 is loosely seated in chamber 24 substantially little metal flows around the sides of plunger 54 and back towards the bottom of the bath due to the viscosity of the molten metal itself. As the top surface 62 of the molten metal trapped by plunger 54 reaches the height of portion 40 in exit port 38, the molten metal trapped will begin to flow into exit port 38. Because only a small portion of the metal is exposed to exit aperture 38 at a time, and because of the pitch or angle of portion 40 in exit port 38, the molten metal will begin immediately to flow in small quantities out of exit 38 down trough or conduit pipe 42 to shot sleeve 14.

The upward movement of plunger 54 can be stopped at any point desired by the operator in order to allow only the desired amount of molten metal trapped above surface 56 to flow to shot sleeve 14. When the operator feels that a sufficient quantity of molten metal has been passed to sleeve 14, he can terminate operation of hydraulic piston 48 and further upward movement of plunger 54. Of course, it is understood that as plunger 54 rises and as the topmost point 60 of surface 56 passes above portion 40 of aperture 38, the pitch or angle of top surface 56 will further facilitate a smooth steady flow of molten metal from above top surface 56 into exit port 38. If it is desired, all of the trapped molten metal can be passed to the shot sleeve 14 by raising plunger 54 so that the lowest point 58 of top surface 56 is positioned adjacent portion 40 of exit port 38.

Again it should be noted that the pitch of exit trough 38 and top surface 56 facilitates smooth and steady flow of the molten metal out of the chamber 24 in a manner which allows control of the amount discharged and which prevents the material that is being discharged from flowing at a rate and in a quantity which can overflow and cause damage or injury. The pitch of top surface 56 allows only a small amount of the material to be exposed to exit port 38 at a time and to flow into that exit port, further facilitating control over the flow of molten metal.

In a casting operation such as employs the above described metering and transfer device 20, the casting operator, after a few operations can determine the amount of molten material required to be passed to shot sleeve 14 in order to properly fill the mold and produce a correct casting. As already noted, the amount of material discharged from device 20 is primarily determined by the height to which plunger 54 rises. It is feasible, and most likely, that an automatic control system will be utilized with device 20 in order to control and limit the upward movement of plunger 54. The control system can take the form of cams and actuators on, or attached to, plunger rod 50 which actuate the controls for hydraulic piston 48 to stop upward movement of rod 50 when a specific height is reached. In this manner, an automatic system for discharging a predetermined amount of molten metal from a bath 10 to a shot sleeve 14 of a cold chamber is provided.

What is desired to secure by Letters Patent in the United States is:

1. A molten metal metering and transfer device for use with a molding machine and a bath for holding and heating a molten metal, including in combination, a wall means forming a chamber supported in said bath with a first end of said chamber extending out of said molten metal and with the axis of said chamber extending substantially perpendicular to the surface of said molten metal, entry means for allowing entry of said molten metal into said chamber, exit means adjacent said chamber first end and above said molten metal surface for allowing exit of said molten metal from said chamber, a plunger seated in said chamber and adapted to move in a first direction into said bath and in a second direction out of said bath along the axis of said chamber said plunger when seated in said chamber having a plunger top surface extending at an angle with respect to said molten metal surface and said chamber axis, said plunger when moved in said second direction trapping a predetermined amount of molten metal above said plunger top surface and raising said trapped metal above the molten metal surface to said exit means, said plunger top surface, at the effective end point of travel in the second direction, including a lowest point positioned in said chamber adjacent said exit means and a highest point positioned above and substantially opposite said exit means for facilitating said flow of trapped molten metal through said exit means, said plunger top surface, at the effective end point of travel in the first direction, having said highest point of the plunger top surface positioned below the entry means.

2. The metering and transfer device of claim 1 wherein said entry means is formed in said wall means and extends partially into and partially out of said molten metal.

3. The metering and transfer device of claim 1 wherein said entry means is an aperture formed through said wall means for allowing entry of said molten metal into said chamber, said aperture extending partially into and out of said molten metal.

4. The metering and transfer device of claim 3 wherein, at the effective end point of travel of said plunger in said first direction, said plunger top surface is below said molten metal surface.

5. The metering and transfer device of claim 4 wherein said plunger top moves in said second direction from below the molten metal surface and expels a portion of said molten metal from said chamber through said entry means, said plunger passing said entry means during movement in said second direction and trapping said predetermined amount of molten metal.

6. The metering and transfer device of claim 1 wherein the length of travel of said plunger in said second direction determines the amount of said predetermined trapped molten metal discharged through said exit means.

7. The metering and transfer device of claim 1 wherein said wall means is a cylindrical wall, said chamber is a cylindrical chamber, and said plunger is a truncated cylinder.

8. The metering and transfer device of claim 1 further including a plunger stem secured to said plunger for reciprocating said plunger in said first and second direction.

9. The metering and transfer device of claim 8 further including hydraulic means secured to said plunger stem and selectively operative to reciprocate said plunger stem and plunger in said first and second directions.

10. The metering and transfer device of claim 1 wherein said exit means is formed through said wall means adjacent said chamber first end, said exit means including a portion extending at substantially the angle of the plunger top surface with respect to said molten metal surface and said chamber axis for facilitating a flow of said trapped molten metal from said plunger top surface through said exit means.

11. The metering and transfer device of claim 10 wherein said exit means is a conduit formed through said wall means, said conduit including a portion extending substantially at the angle of the plunger top surface.

12. The metering and transfer device of claim 11 wherein said conduit is a trough.

13. A molten metal metering and transfer device for use with a molding machine and a bath for holding and heating molten metal including in combination;

a hollow elongate container forming a chamber therein and having a top end and a bottom end and an axis in the elongate direction, means for supporting said container in said bath with said top end extending above the normal upper surface level of the molten metal, and the bottom end extending below the normal upper surface level of the molten metal with said elongate axis extending substantially perpendicular to the molten metal surface, an entry port formed in said container between the top end and bottom end, said entry port being positioned to extend partially above and partially below the normal upper surface level of the molten metal when said container is mounted in the bath, an exit port formed in said container adjacent said top end, said exit port including a portion extending at an angle with respect to said axis for allowing free flow of said molten metal from said chamber through said exit port, a plunger seated in said chamber and adapted to move in a first direction into said bath and in a second direction out of said bath along the axis, said plunger when seated in said chamber having a plunger top surface extending at substantially an inclined angle with respect to said axis, said plunger when moved in said second direction being adapted to trap a predetermined amount of molten metal above said plunger top surface and raise said trapped metal out of said bath to said exit port, said top surface angle facilitating a flow of said trapped molten metal through said exit means, said plunger top surface, at an end point of travel in the second direction, including a lower point positioned in said chamber adjacent said exit port and a higher point positioned substantially opposite said exit port for facilitating said flow of trapped molten metal through said exit port, said plunger top surface, at an end point of travel in the first direction, having said higher point of the plunger top surface positioned below the entry port.

14. The molten metal metering and transfer device of claim 13 wherein said plunger reciprocates in said second direction to a particular height, said particular height determining the amount of said predetermined trapped molten metal discharged through said exit port.

15. The metering and transfer device of claim 13 further including hydraulic means coupled to said plunger and selectively operative to move said plunger in said first and second directions.

16. The molten metal metering and transfer device of claim 13 wherein said extending portion of the exit port extends at substantially the inclined angle of the plunger top.

* * * * *